US007401700B2

(12) United States Patent
Dost et al.

(10) Patent No.: US 7,401,700 B2
(45) Date of Patent: Jul. 22, 2008

(54) TOOL ACCESSORY CASE INDEX

(75) Inventors: Hagen W. Dost, Chicago, IL (US); Melvin A. Pendergraph, Arlington Heights, IL (US); Brian M. Chiaruttini, Harwood Heights, IL (US); Patrick M. McAuliffe, Chicago, IL (US); Javier Ibarra-Sandoval, Des Plaines, IL (US)

(73) Assignee: Robert Bosch GmbH, Stuttgart (DE)

( * ) Notice: Subject to any disclaimer, the term of this patent is extended or adjusted under 35 U.S.C. 154(b) by 339 days.

(21) Appl. No.: 11/063,015

(22) Filed: Feb. 22, 2005

(65) Prior Publication Data

US 2006/0186007 A1 Aug. 24, 2006

(51) Int. Cl.
*B65D 85/28* (2006.01)

(52) U.S. Cl. ..... 206/379; 206/372; 211/69

(58) Field of Classification Search ..... 206/349, 206/372, 373, 379, 759, 762, 765; 211/69, 211/70.6

See application file for complete search history.

(56) References Cited

U.S. PATENT DOCUMENTS

| | | | | | |
|---|---|---|---|---|---|
| 2,792,935 | A * | 5/1957 | Rocchetti | ..... | 206/379 |
| 4,006,821 | A * | 2/1977 | Sautter | ..... | 206/379 |
| 4,512,467 | A * | 4/1985 | Knoblauch | ..... | 206/379 |
| 4,934,530 | A * | 6/1990 | Riess | ..... | 206/379 |
| 5,368,164 | A * | 11/1994 | Bennett et al. | ..... | 206/373 |
| 5,746,316 | A * | 5/1998 | La Barre | ..... | 206/379 |
| 5,775,499 | A * | 7/1998 | Budert | ..... | 206/379 |
| 5,967,318 | A * | 10/1999 | Rosler | ..... | 206/372 |
| 6,213,296 | B1 * | 4/2001 | Streich et al. | ..... | 206/373 |
| 6,283,291 | B1 * | 9/2001 | Vasudeva et al. | ..... | 206/373 |
| 6,755,302 | B1 * | 6/2004 | Streich et al. | ..... | 206/373 |
| 6,953,114 | B2 * | 10/2005 | Wang | ..... | 206/375 |
| 6,991,103 | B2 * | 1/2006 | Chen | ..... | 206/373 |
| 2003/0006157 | A1 * | 1/2003 | Vasudeva | ..... | 206/379 |
| 2004/0200749 | A1 * | 10/2004 | Wang | ..... | 206/373 |
| 2005/0211587 | A1 * | 9/2005 | Chen | ..... | 206/379 |

* cited by examiner

*Primary Examiner*—David T Fidei
(74) *Attorney, Agent, or Firm*—Greer, Burns & Crain, Ltd.

(57) ABSTRACT

The present invention is directed to a tool accessory case having a first and a second housing member pivotally connected to each other along a hinge portion and forming a tool holding cavity. The tool accessory case also has at least one index configured for receiving at least one elongated tool accessory disposed in one of the housing members. The index has an upper guide for contacting an upper portion of the tool accessory, and a lower guide for contacting a lower portion of the tool accessory. Further, a flexible arm is included on either the index or one of the first and second housing members. The flexible arm is configured for deforming and applying a lateral pressure to the lower portion of the tool accessory for the purpose of positively retaining the tool accessory in the index. The tool accessory is slidingly received by the index, and the lateral pressure is applied by the flexible arm when the tool accessory is generally entirely received by the index.

17 Claims, 4 Drawing Sheets

TOOL ACCESSORY CASE INDEX

FIELD OF THE INVENTION

The present invention is related to tool accessory cases. More particularly, the present invention is related to tool accessory indexes for retaining tool accessories.

BACKGROUND OF THE INVENTION

Tool accessory cases are commonly used by consumers and individuals in many professions to organize small parts such as drill bits, fasteners, and the like. Frequently, accessories of this sort are available in sets of varying size and shape and are used for different purposes. It is desirable to keep the accessories organized so that the user can easily locate the specific tool accessory for the particular purpose.

The tool accessories are commonly organized in individual compartments or indexes within the tool accessory case in order of size and type. The compartments retain the tool accessory while also permitting the user to easily select and remove the tool accessory from the compartment. Typically, the compartment does not positively retain the tool accessory when the case is opened and inverted, or when the case is dropped. Alternatively, when the tool accessories are positively retained by the compartment, the tool accessories are typically difficult to grasp and remove, particularly if the user is wearing work gloves or only has one hand available.

SUMMARY OF THE INVENTION

A preferred embodiment of the present invention is directed to a tool accessory case having a first and a second housing member pivotally connected to each other along a hinge portion and forming a tool holding cavity. The tool accessory case also has at least one index disposed in one of the housing members and configured for receiving at least one elongated tool accessory. The index has an upper guide for contacting an upper portion of the tool accessory, and a lower guide for contacting a lower portion of the tool accessory. Further, a flexible arm is included on either the index or one of the first and second housing members. The flexible arm is configured for deforming and applying a lateral pressure to the lower portion of the tool accessory for the purpose of positively retaining the tool accessory in the index. The tool accessory is slidingly received by the index, and the lateral pressure is applied by the flexible arm when the tool accessory is generally entirely received by the index.

In another embodiment of a tool accessory case, an index further includes a flexible arm disposed adjacent a lower guide and extending generally perpendicularly towards a peripheral side surface of a tool accessory.

Another feature of the present invention is directed to a tool accessory case having first and second housing members pivotally connected to each other along a hinge portion and forming a tool holding cavity. Each of the first and the second housing members have at least a first portion and a second portion located opposed to the first portion. The tool accessory case also has at least first and second indexes for receiving at least two elongated tool accessories of unequal lengths. The indexes are disposed in at least one of the housing members, and the first index is disposed in the first portion and the second index is disposed in the second portion in an opposed configuration to the first index. In this configuration, longer length accessories of the first index are generally aligned with shorter length accessories of the second index so that the total length of aligned accessories are generally similar.

DETAILED DESCRIPTION

Figure 1:
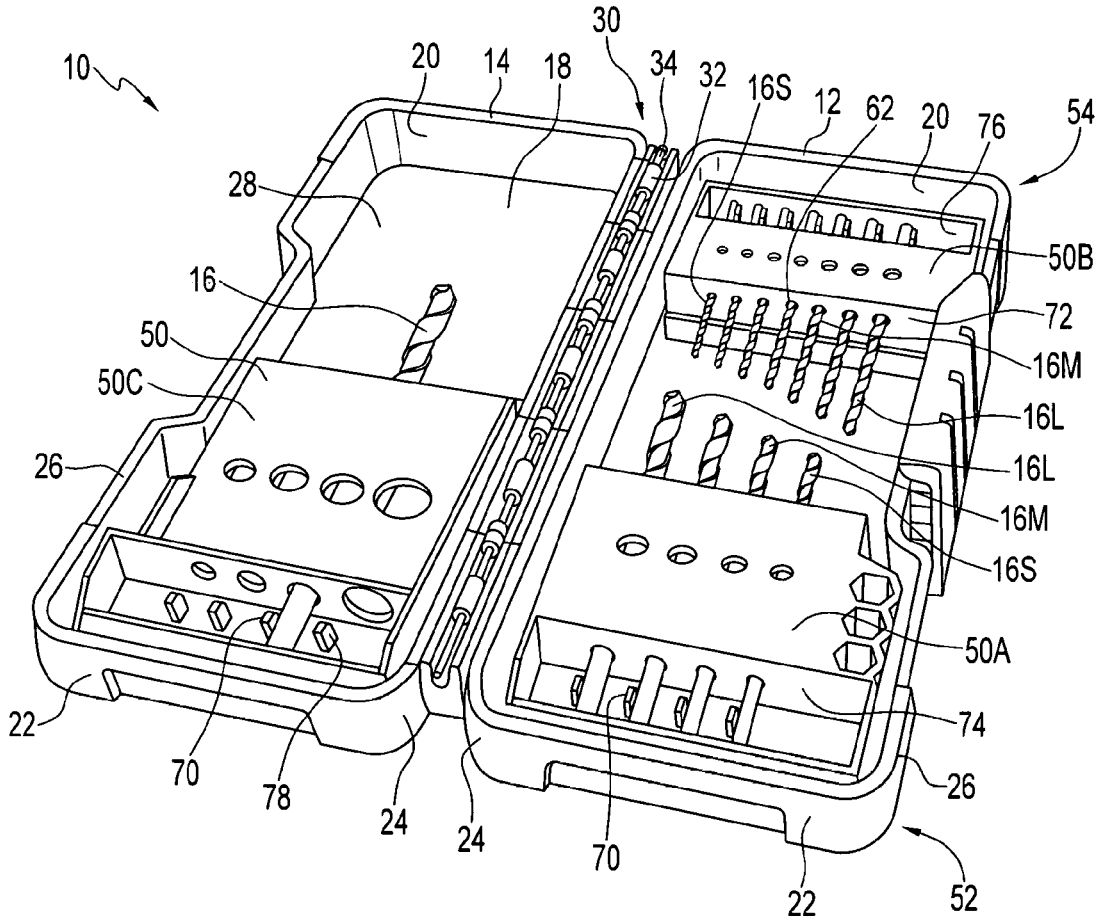
FIG. 1 is a perspective view of a tool accessory case with a plurality of indexes disposed therein.

Turning now to the drawings, and particularly to FIG. 1, a tool accessory case indicated generally at 10 is shown to have a generally rectangular housing having first and second housing members 12, 14 in which elongated tool accessories 16 can be stored. Each housing member 12, 14 preferably includes a base 18 with two short sides 20, 22, a hinged side 24 and a top side 26 defining a tool holding cavity 28 therein, as is known in the art. Preferably, the accessory case 10 is made of molded plastic, but other materials may be used.

The hinged side 24 of the housing members 12, 14 are pivotally connected to each other along a hinge 30, which permits the housing members to open and close with respect to each other. The hinge 30 is preferably an integrally formed sleeve 32 with a rod 34 disposed therein, however other hinges are contemplated. A latch is configured to maintain the case 10 in a closed position.

A detailed description of the preferred latch is disclosed in U.S. patent application Ser. No. 11/062,373, entitled "Latch for Tool Accessory Case", filed Feb. 22, 2005, which is incorporated by reference herein.

Preferably pivotally disposed in the first and the second housing members 12, 14 is at least one index 50 configured for receiving tool accessories, such as the tool accessory 16. More preferably, the housing member 12 has a first index 50A disposed in a first portion 52 of the housing member and a second index 50B disposed in a second portion 54 of the housing member. The first and second indexes 50A and 50B each preferably hold more than one of the tool accessories 16. In the two index configuration, the indexes 50A, 50B oppose each other such that the indexes have a generally opposite or complementary orientation in the plane of the base 18, in that larger accessories located in one index are generally aligned with the smaller accessories of the other index. Further, it is contemplated that a single index 50C can be pivotally disposed in one of the housing members 12, 14.

Still referring to FIG. 1, the indexes 50 are used to sort and organize the tool accessories 16 according to tool accessory characteristics, such as size, shape or purpose. In the preferred embodiment, the indexes 50 organize drill bits according to length and diameter of the drill bit. Although the indexes 50 are shown retaining drill bits, the indexes may also be used for retaining other tool accessories 16 such as driver bit sets, router bit sets and reciprocating saw sets.

Referring back to the two-index configuration where the indexes 50A, 50B oppose each other, a longer length tool accessory 16L of the first index 50A is generally aligned with a shorter length tool accessory 16S of the second index 50B so that the total length of the aligned accessories are generally similar. In other words, the long tool accessory 16L of the first index 50A is generally aligned with the short tool accessory 16S of the second index 50B, the short tool accessory 16S of the first index 50A is generally aligned with a long tool accessory 16L of the second index 50B, and a medium tool accessory 16M of the first and second indexes 50A, 50B are generally aligned. Further, it is contemplated that the accessories 16 of the first index 50A may be off-set with the tool accessories of the second index 50B. It is also contemplated that an arrangement of three or more indexes can be implemented.

Figure 2:
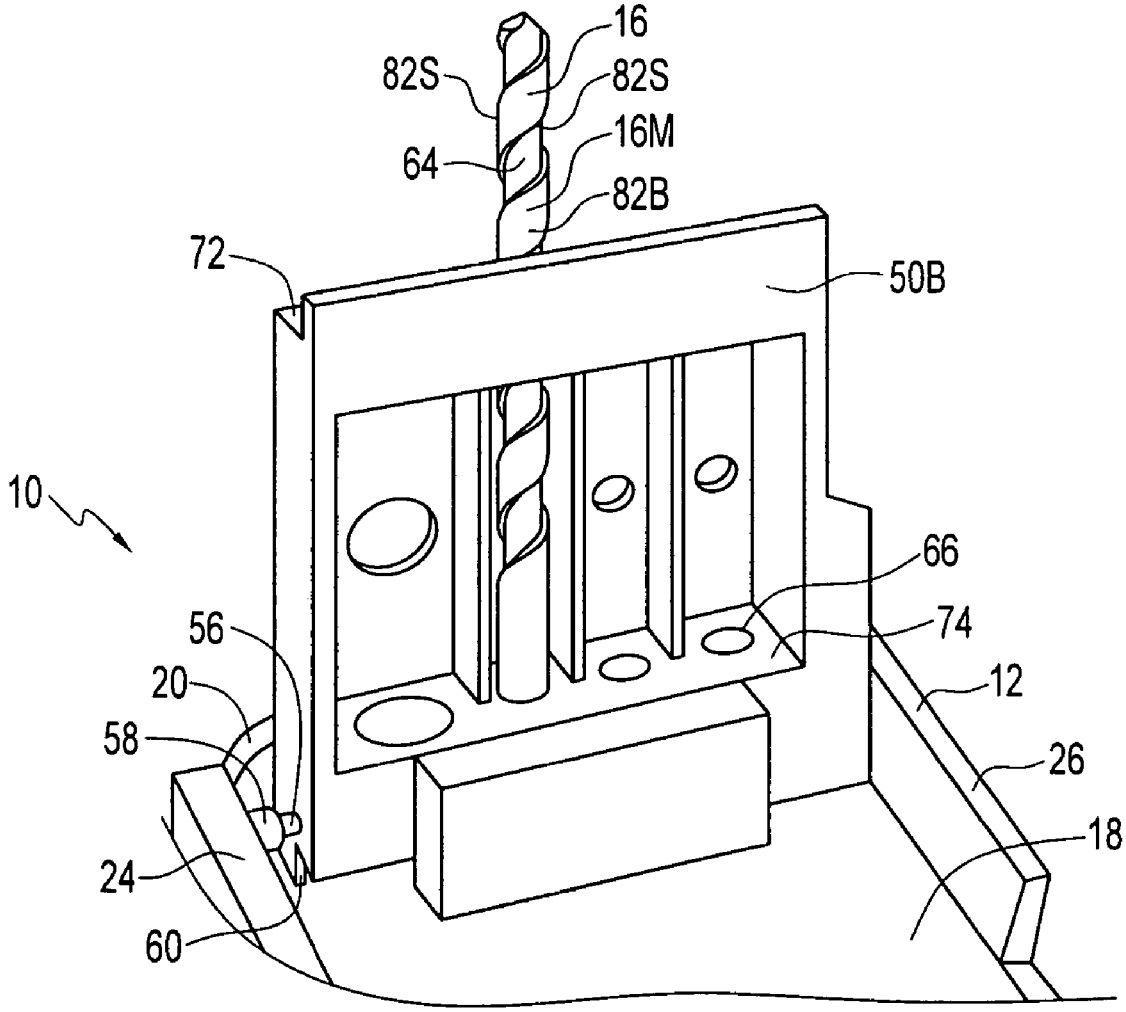
FIG. 2 is a partial perspective view of the tool accessory case of FIG. 1 with one of the indexes pivoted to an upright position.

Referring now to FIG. 2, the indexes 50 are preferably pivotally disposed in the housing members 12, 14, such as by engaging a protruding pin 56 of the index in a collar 58 disposed in the side 24 of the housing member 12. In this configuration, the index 50 can be pivoted generally between zero and 90-degrees. Preferably, the index 50 also has at least one leg 60 which engages the base 18 when the index is in an upright or 90-degree position from the base 18. The upright position of the index 50 allows the user to grasp, remove or insert the tool accessory 16 into the index. Further, when the tool accessories 16 are stored in the tool accessory case 10, the index 50 is pivoted to have a generally parallel alignment with the base 18 to permit the housing members 12, 14 to close with respect to each other and define the cavity 28. It is also contemplated that the tool accessories 16 can be grasped, removed and inserted into the index 50 when the index is in the retracted or zero-degree position.

Figure 3:
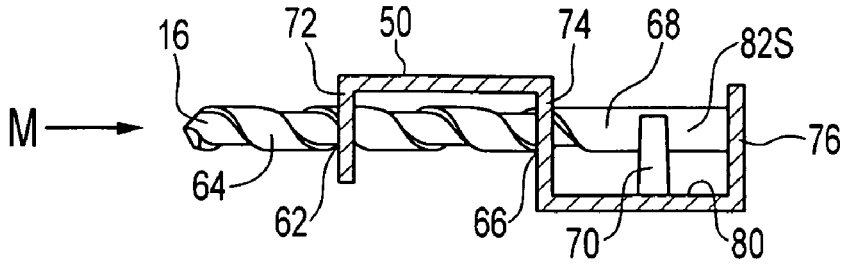
FIG. 3 is a section view of the index of FIG. 1 with a tool accessory disposed in the index.

Referring now to FIGS. 1-3, the index 50 has an upper guide 62 configured for contacting an upper portion 64 of the tool accessory 16 and a lower guide 66 configured for contacting a lower portion 68 of the tool accessory 16. Adjacent the lower guide 66, the index 50 also has a flexible arm 70 configured for applying a lateral pressure to the lower portion 68 of the tool accessory 16. In this way, the index 50 is a separate member from the first and second housing members 12, 14, and further the upper guide 62, the lower guide 66 and the flexible arm 70 are preferably all part of the same member.

When viewed in cross section, the index 50 has a general "S"-shape configuration and the tool accessory 16 is introduced into the index 50 from an upper guide member 72 into a lower guide member 74 and until it contacts a stop member 76. In this way, the tool accessory 16 is introduced into the index 50 in the lengthwise direction of the "S"-shape. It is contemplated that other configurations of indexes for contacting the tool accessory 16 at three or more points may be used.

In the preferred embodiment, the tool accessory 16 is slidingly received into the upper guide 62, which is preferably an aperture having a diameter sized slightly larger than the diameter of the tool accessory. Further, the tool accessory 16 is preferably slidingly received into the lower guide 66, also preferably an aperture having a diameter slightly larger than the diameter of the tool accessory. The tool accessory 16 is then slidingly received by both the upper and lower guides 62, 66 until the tool accessory contacts the stop member 76. Further, while the upper and lower guides preferably circumscribe the tool accessory, it is contemplated that other configurations of the guides may be used. For example, the guides 62, 66 may cradle the tool accessory or the guides may have a non-circular geometry.

When the tool accessory 16 is almost entirely slidingly received into the index 50, the flexible arm 70 is preferably deformed and applies a lateral pressure to the lower portion 68 of the tool accessory. A tool contact surface 78 of the flexible arm 70 contacts the tool accessory 16. The flexible arm 70 is configured to flex and deform generally perpendicularly from the direction of movement "M" of the tool accessory 16 when the tool accessory is slidingly received in the index 50.

A bottom portion 80 is disposed between the lower guide member 74 and the stop member 76. At the bottom portion 80, the flexible arm 70 extends generally perpendicularly towards a peripheral side surface 82S of the tool accessory 16. With reference to the tool accessory 16 of FIGS. 1 and 2, each peripheral side surface 82S is generally the portion of the surface of the tool accessory which faces another tool accessory, or which faces the sides of the housing member 12, 14. When the tool accessory 16 is generally entirely slidingly received in the index 50, the accessories are positively retained in the index by the lateral pressure imparted by the flexible arm 70 at the peripheral side surface 82S. In this configuration, the tool accessories 16 are positively retained so that they should not normally become dislodged during case inversions and drop impacts.

Figure 4:
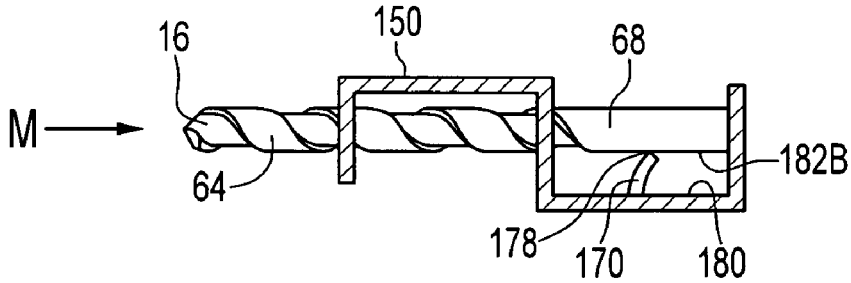
FIG. 4 is a section view of a second embodiment of an index for the tool accessory case of FIG. 1 with a tool accessory disposed in the index.

Referring now to FIG. 4, a second embodiment of the index for the tool accessory 16 is generally designated 150 and has a flexible arm 170 disposed on a bottom portion 180 of the index. Shared components with the first embodiment of the index 50 are designated with identical reference numbers and similar components with the first embodiment are designated with corresponding reference numbers in the 100-series.

In the index 150, the flexible arm 170 is disposed on the bottom portion 180 of the index and extends generally perpendicularly from the bottom portion. Upon engagement with the tool accessory 16, the flexible arm 170 is configured to flex and deform generally in the direction of movement "M" of the tool accessory when the tool accessory is slidingly received in the index. Unlike the index 50, the flexible arm 170 of the index 150 extends generally perpendicularly towards a peripheral bottom surface 182B of the tool accessory 16. With reference to FIGS. 2 and 4, the peripheral bottom surface 182B is generally the portion of the tool accessory 16 which faces the base 18 of the housing members 12, 14.

A contact surface 178 of the flexible arm 170 is configured to contact the tool accessory 16 at the peripheral bottom surface 182B. Similar to the index 50, the index 150 is configured to apply a lateral pressure to the tool accessory 16 when the accessory is generally entirely slidingly received in the index. Preferably, the lateral pressure is applied when the flexible arm 170 contacts the peripheral bottom surface 182B to positively retain the tool accessory 16 in the index 150.

Figure 5:
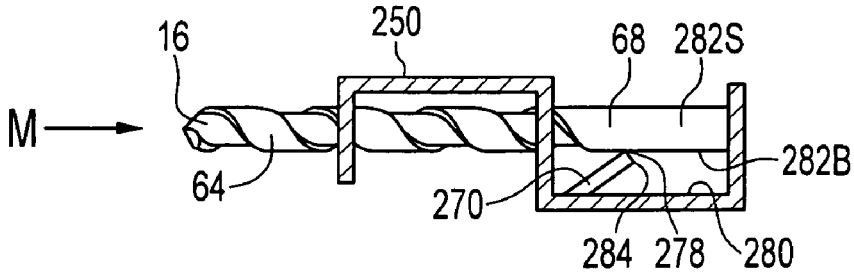
FIG. 5 is a section view of a third embodiment of an index for the tool accessory case of FIG. 1 with a tool accessory disposed in the index.

The third embodiment of the index for the tool accessory 16 is generally designated 250 and is shown in FIG. 5. Shared components of the index 50 are designated with identical reference numbers and similar components with the first embodiment are designated with corresponding reference numbers in the 200-series.

The index 250 also has a flexible arm 270 disposed at a bottom portion 280 of the index. The flexible arm 270 extends angularly towards the tool accessory 16, and specifically, the flexible arm extends generally between zero and 90-degrees towards a peripheral bottom surface 282B of the tool accessory. It is contemplated that the flexible arm 270 can also extend toward a peripheral side surface 282S of the tool accessory 16. A contact surface 278 of the flexible arm 270 is generally disposed at a distal end 284 of the flexible arm.

Upon engagement with the tool accessory 16, the flexible arm 270 is configured to deform and deflect generally in the same direction of movement "M" of the tool accessory 16 when the accessory is slidingly received in the index 50. A lateral pressure is applied to the lower portion 68 of the tool accessory 16 such that the tool accessory is positively retained in the index 250.

Figure 6:
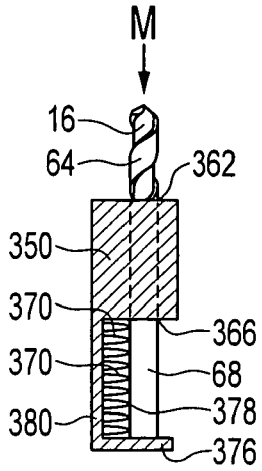
FIG. 6 is a section view of a fourth embodiment of an index for the tool accessory case of FIG. 1 with a tool accessory disposed in the index.

Referring now to FIG. 6, a fourth embodiment of the index for a tool accessory 16 is generally designated 350 and is shown in cross-section. Shared components with the index 50 and the tool accessory 16 are designated with identical reference numbers and similar components with the index 50 are designated with corresponding reference number in the 300-series. The fourth embodiment generally functions similarly to the first, second and third embodiments in that the index 350 has an upper guide 362, a lower guide 366 and a flexible arm 370.

In contrast to the index 250, the index 350 has a plurality of flexible arms 370 disposed at a bottom portion 380 of the index. Preferably, each of the plurality of flexible arms 370 has at least one contact surface 378 configured to contact the tool accessory 16. The plurality of flexible arms 370 are configured to deform and flex generally in the same direction "M" of the tool accessory 16 when the tool accessory is slidingly received in the index 350. Further, it is contemplated that the plurality of arms 370 can have any spacing or arrangement.

Figure 7:
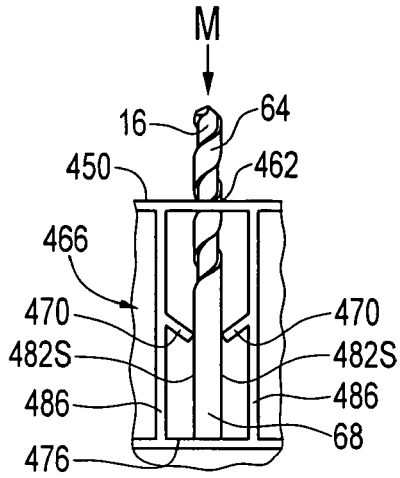
FIG. 7 is a partial front view of a fifth embodiment of an index for the tool accessory case of FIG. 1 with a tool accessory disposed in the index.

A fifth embodiment of the index for a tool accessory 16 is shown in FIG. 7 and is generally designated 450. Shared components with the first index 50 and the tool accessory 16 are designated with identical reference numbers and similar components with the first embodiment are designated with corresponding reference numbers in the 400-series.

In the index 450 there is an upper guide 462 and a lower guide indicated generally at 466 which includes at least one flexible arm 470, and preferably includes at least two flexible arms. The upper guide 462 preferably circumscribes the tool accessory 16, although other configurations are contemplated. The lower guide 466 is preferably disposed on a plurality of elongated ribs 486 which preferably connect the upper guide 462 with a stop member 476, although other index 450 configurations are contemplated.

The flexible arms 470 are preferably configured to contact the peripheral side surfaces 482S of the tool accessory 16. The flexible arms 470 are preferably oriented at an angle between zero and 180-degrees with respect to the elongate ribs 486 and together form an interference fit with the tool accessory 16. More preferably, the flexible arms 16 are configured to deform generally in the same direction of movement "M" of the tool accessory 16 when the tool accessory is slidingly received in the index 450.

Figure 8:
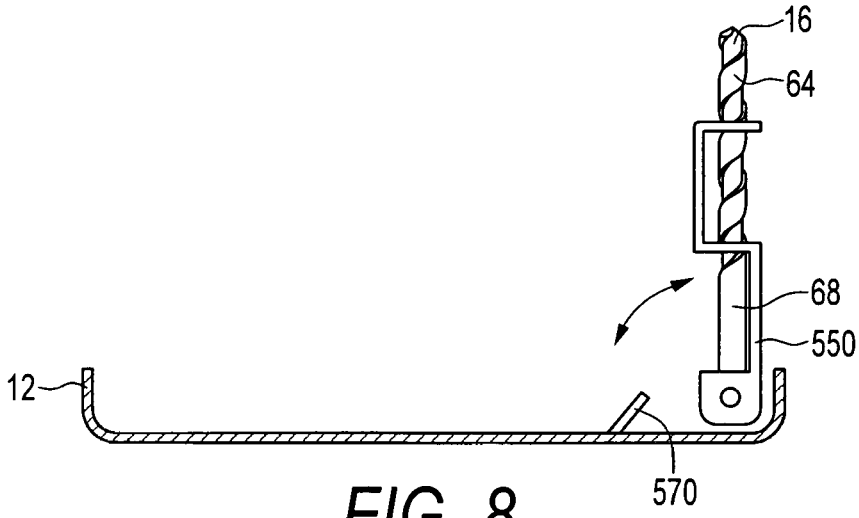
FIG. 8 is a side plan view of a sixth embodiment of an index for the tool accessory case of FIG. 1 with the index in an upright position.
Figure 9:
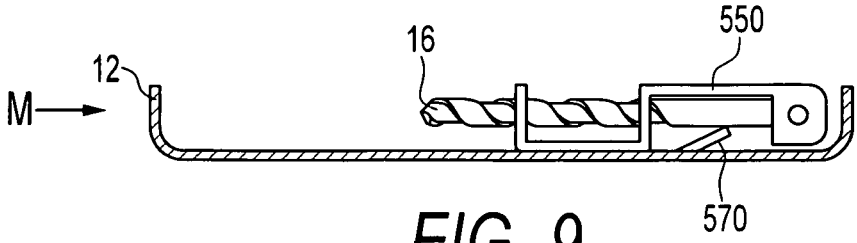
FIG. 9 is a side plan view of the index of FIG. 8 in a retracted position.

Referring now to FIGS. 8 and 9, a sixth embodiment of the index for a tool accessory 16 is generally designated 550 and it is shown in both an upright position and a retracted position. Shared components with the index 50 and the tool accessory 16 are designated with identical reference numbers and similar components with the index 50 are designated with corresponding reference numbers in the 500-series.

In the index 550, a flexible arm 570 is integral with the first or second housing member 12, 14. When the index 550 is pivoted into the retracted position, and when the tool accessory 16 is slidingly received into the index, the flexible arm 570 is deflected upon engagement with the tool accessory. The flexible arm 570 is preferably configured to contact a peripheral bottom surface 582 of the tool accessory 16. Further, the flexible arm 570 is preferably configured to deform generally in the same direction of movement "M" of the tool accessory 16 when the tool accessory is slidingly received in the index 550.

While various embodiments of the present invention have been shown and described, it should be understood that other modifications, substitutions, and alternatives are apparent to one of ordinary skill in the art. Such medications, substitutions and alternatives can be made without departing from the spirit and scope of the invention, which should be determined from the appended claims.

Various features of the invention are set forth in the following claims.

What is claimed is:

1. A tool accessory case comprising:

first and second housing members pivotally connected to each other along a hinge portion, said housing members forming a tool holding cavity;

at least one index configured for receiving at least one elongated tool accessory disposed in one of said housing members, said index having an upper guide configured for contacting an upper portion of said tool accessory and a lower guide for contacting a lower portion of said tool accessory, said index having at least two flexible arms configured for deforming and applying a lateral pressure to said lower portion of each said tool accessory for the purpose of positively retaining said tool accessory in said index;

wherein said elongated tool accessory is slidingly received by said index, and said lateral pressure is applied when said tool accessory is generally entirely received by said index.

2. A tool accessory case as defined in claim 1 wherein said index is pivotally disposed in said first and second housing members.

3. A tool accessory case as defined in claim 1 wherein each said flexible arm has at least one contact surface configured to contact said tool accessory.

4. A tool accessory case as defined in claim 3 wherein upon engagement with said tool accessory, each said flexible arm is configured to deform generally perpendicularly from the direction of movement of said tool accessory when said tool accessory is slidingly received in said index.

5. A tool accessory case as defined in claim 3 wherein upon engagement with said tool accessory, each said flexible arm is configured to deform generally in the same direction of movement of said tool accessory when said tool accessory is slidingly received in said index.

6. A tool accessory case as defined in claim 4 wherein each said flexible arm extends generally perpendicularly towards a peripheral side surface of said tool accessory.

7. A tool accessory case as defined in claim 5 wherein each said flexible arm extends generally perpendicularly towards a peripheral bottom surface of said tool accessory.

8. A tool accessory case as defined in claim 5 wherein each said flexible arm extends generally between zero and 90-degrees towards a peripheral bottom surface of said tool accessory.

9. A tool accessory case as defined in claim 1 wherein said at least two flexible arms comprise a plurality of flexible arms located adjacent one another on one side of said tool accessory.

10. A tool accessory case as defined in claim 1 wherein said at least two flexible arms are positioned on opposite sides of each tool accessory and are configured to apply generally equal force on opposite sides of said tool accessory.

11. A tool accessory case as defined in claim 1 wherein said upper guide circumscribes the tool accessory.

12. A tool accessory case as defined in claim 1 wherein said lateral pressure to said lower portion of said tool accessory is applied when said tool accessory is substantially slidingly received in said index.

13. A tool accessory case comprising:

first and second housing members pivotally connected to each other along a hinge portion, said housing members forming a tool holding cavity;

at least one index configured for receiving at least one elongated tool accessory disposed in one of said housing members, said index having an upper guide configured for contacting an upper portion of said tool accessory and a lower guide for contacting a lower portion of said tool accessory, said index further having a plurality of flexible arms disposed adjacent to and generally parallel to one another and said lower guide and extending generally perpendicularly towards a peripheral side surface of each said tool accessory, each of said flexible arms being configured to deform and apply a lateral pressure to said lower portion of said tool accessory for the purpose of positively retaining said tool accessory in the index;

wherein said elongated tool accessory is slidingly received by said index, and said lateral pressure is applied when said accessory is generally entirely received by said index.

14. A tool accessory case as defined in claim 13 wherein said index is pivotally disposed in at least one of said first and second housing members.

15. A tool accessory case as defined in claim 14 wherein said upper guide, said lower guide and said flexible arms are integrally formed.

16. A tool accessory case as defined in claim 13 wherein upon engagement with said tool accessory, said flexible arms are configured to flex generally perpendicularly from the direction of movement of said tool accessory when said tool accessory is slidingly received in said index.

17. A tool accessory case comprising:

first and second housing members pivotally connected to each other along a hinge portion, said housing members forming a tool holding cavity;

at least one index configured for receiving at least one elongated tool accessory disposed in one of said housing members, said index having an upper guide configured for contacting an upper portion of said tool accessory and a lower guide for contacting a lower portion of said tool accessory, said index further having at least two flexible arms disposed on opposite sides of each tool accessory configured to apply a force on each tool accessory from opposite sides for the purpose of positively retaining said tool accessory in said index;

wherein said elongated tool accessory is slidingly received by said index, and said lateral pressure is applied when said accessory is generally entirely received by said index.

* * * * *